United States Patent [19]

Corain

[11] Patent Number: 4,538,648

[45] Date of Patent: Sep. 3, 1985

[54] HEALD CONTROL SYSTEM FOR A TRAVELLING WAVE SHEDDING LOOM

[75] Inventor: Luciano Corain, Vicenza, Italy

[73] Assignee: Nuovo Pignone S.p.A., Florence, Italy

[21] Appl. No.: 544,648

[22] Filed: Oct. 24, 1983

[30] Foreign Application Priority Data

Nov. 5, 1982 [IT] Italy ..... 24092 A/82

[51] Int. Cl.[3] ..... D03C 5/00

[52] U.S. Cl. ..... 139/79; 139/90; 139/436

[58] Field of Search ..... 139/55.1, 56, 57, 79, 139/80, 436, 90

[56] References Cited

U.S. PATENT DOCUMENTS 2,728,358 12/1955 Kools ..... 139/55.1
3,695,304 10/1972 Menegatto ..... 139/57
3,866,634 2/1975 Rutkevich et al. ..... 139/79

FOREIGN PATENT DOCUMENTS 1346144 2/1974 United Kingdom ..... 139/436
1372784 6/1974 United Kingdom ..... 139/436

*Primary Examiner*—Henry S. Jaudon
*Attorney, Agent, or Firm*—Morgan, Finnegan, Pine, Foley & Lee

[57] ABSTRACT

A heald control system for a multi-phase or travelling wave shedding loom in which each heald is upperly connected elastically, by way of an elastic traction element, to a single support plate which is removably locked to the fixed part of the loom, and the healds of each section are lowerly locked to a single connection block which is connected by a spring catch connector to a flexible element, which is itself connected to the end of a cam-controlled operating lever.

5 Claims, 4 Drawing Figures

HEALD CONTROL SYSTEM FOR A TRAVELLING WAVE SHEDDING LOOM

BACKGROUND OF THE INVENTION

This invention relates to an improved heald control system, particularly suitable for multi-phase or travelling wave shedding looms. The invention which eliminates any cause of warp thread wear and which is of very low inertia, is of highly reliable operation at the high speeds required of modern textile looms.

Moreover, by allowing simple and rapid removal and installation of the entire heald assembly on the loom, said control system extremely facilitates the heald setting operation, which can now be done outside the machine, thus enabling this latter to continue to operate in the meantime with another harness (heald assembly). In both single-phase and multi-phase looms for weaving by weft and warp interweaving, the opening of the warp threads in order to form the shed into which the weft thread to be interwoven is inserted is effected by the vertical movement in opposite directions of two sets of healds. The healds include eyes through which pass said warp threads, one per eye. However, in the case of single-phase looms the moving of the healds in order to form a single shed is fairly simple, since all the healds of the two sets are moved simultaneously over the entire weaving height. This is no longer true in the case of multi-phase or travelling wave shedding looms in which the shed opening must take place in front of each of the weft inserters which move along the weaving zone, and must proceed in phase with these. There is therefore not a single open shed but instead a number of sheds equal to the number of weft inserters present in the weaving zone. Consequently the healds of each set must be arranged in the form of waves which travel synchronously with said weft inserters.

The state of the art already comprises various known types of heald control systems for effecting travelling wave opening, which is a characteristic of the multi-phase technology. These known control systems are all based on dividing the entire warp thread assembly and consequently the healds into a succession of small side-by-side sections. These sections behave like the frames of a conventional loom are moved mutually out of phase by a predetermined angle, so as to give rise to the required travelling wave shedding.

In a known construction, each of said sections is constituted substantially by two horizontal heald support arms which together with two vertical rods form a rigid rectangular frame of elongated shape.

However, such a design has considerable drawbacks. Firstly, the rigidity and consequently non-negligible weight of the frames lead to substantial inertial forces as a result of the reciprocating motion of the masses concerned, thus making this construction unsuitable for high-speed operation. In addition, the presence of the vertical rods of the aforesaid frames in the warp thread field creates interference with the warp threads and between the warp threads themselves in the zone surrounding said rods. This interference obstructs the crossing-over of said threads, therefore leading to damaging wear in the thread with consequent increase in the harmful and costly shut-downs of the loom due to thread breakage. Again, said vertical rods obstruct the weaving height, and reduce the maximum obtainable warp density.

In another known construction, said sections include a single vertical rod provided with small transverse arms suitably disposed for carrying the healds.

Although this known construction is of smaller mass and therefore smaller inertia, it however suffers from substantially the same drawbacks as the preceding construction.

The object of the present invention is to obviate the aforesaid drawbacks and thus provide a heald control system for a multi-phase loom which is of low energy consumption by virtue of its small inertia. The heald control system acts on the warp threads in such a manner as to enable them to undergo minimum possible wear during cross-over, and enables high warp densities to be obtained.

SUMMARY OF THE INVENTION

In a heald control system for a multi-phase loom comprising two or more corresponding sets of healds moved vertically in mutual opposition, the healds of the two sets are divided into corresponding side-by-side sections which follow each other and which are moved out of phase with each other by a predetermined angle. Each section is moved by a cam-controlled operating lever, each individual heald is connected upperly to a single support plate by means of its own elastic traction element, and the healds of each section are lowerly locked to a single connection block connected by a flexible element to the end of a cam-controlled operating lever.

In this manner, the healds are always elastically under tension and are therefore made substantially rigid without the need for a rigid and thus heavy support structure.

Furthermore, their inertia is made even smaller by the use of said connection blocks. The connection blocks do not directly connect all the healds to their relative operating levers. A single flexible wire or element is sufficient for each section. In addition, the absence of elements which obstruct the weaving height both prevents warp thread wear by rubbing and enables high warp densities to be obtained.

In order to allow rapid and simple replacement of the heald assembly, according to a further characteristic of the present invention, said single support plate is removably locked to the fixed part of the loom. Said connection blocks are connected to the respective flexible elements by a spring catch connector.

A further characteristic of the present invention is that said connection blocks comprise vertical guide channels into which the lower ends of the healds of the section are inserted and are locked there by a transverse plate which is inserted into slots present at said heald ends.

In this manner, simple extraction of said transverse plate simultaneously releases all the healds of one section from the respective connection blocks, while the vertical guide channels in the block ensure uniform distribution of the healds. This arrangement prevents the healds from becoming grouped on a single side of the block.

According to a further characteristic of the present invention, the two operating levers for the healds of two corresponding sections are controlled by the same cam. The levers are each held against the cam.

This leads to considerable simplification, with obvious economic advantages. Indeed, in order to further increase simplification, according to a further modification of the present invention, two operating levers are held against the control cam by a single spring acting between said two levers.

BRIEF DESCRIPTION OF THE DRAWINGS

The invention will be more apparent with reference to the accompanying drawings which illustrate a preferred embodiment given by way of non-limiting examples, and modifications can be made thereto without departing from the scope of the present invention.

In said drawings.

DETAILED DESCRIPTION OF THE INVENTION

Figure 1:
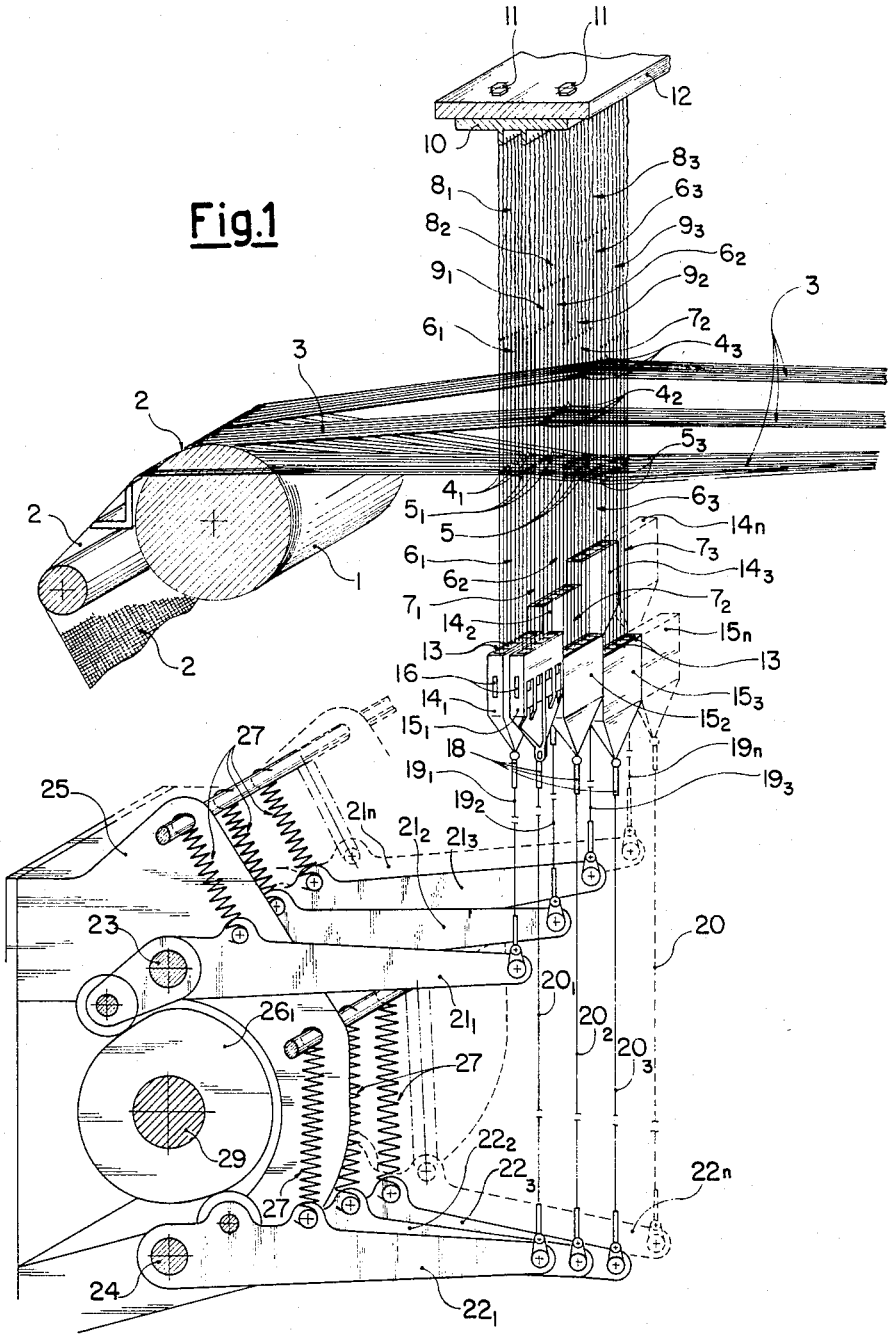
FIG. 1 is a partial perspective view of a multi-phase loom using a heald control system according to the invention.
Figure 2:
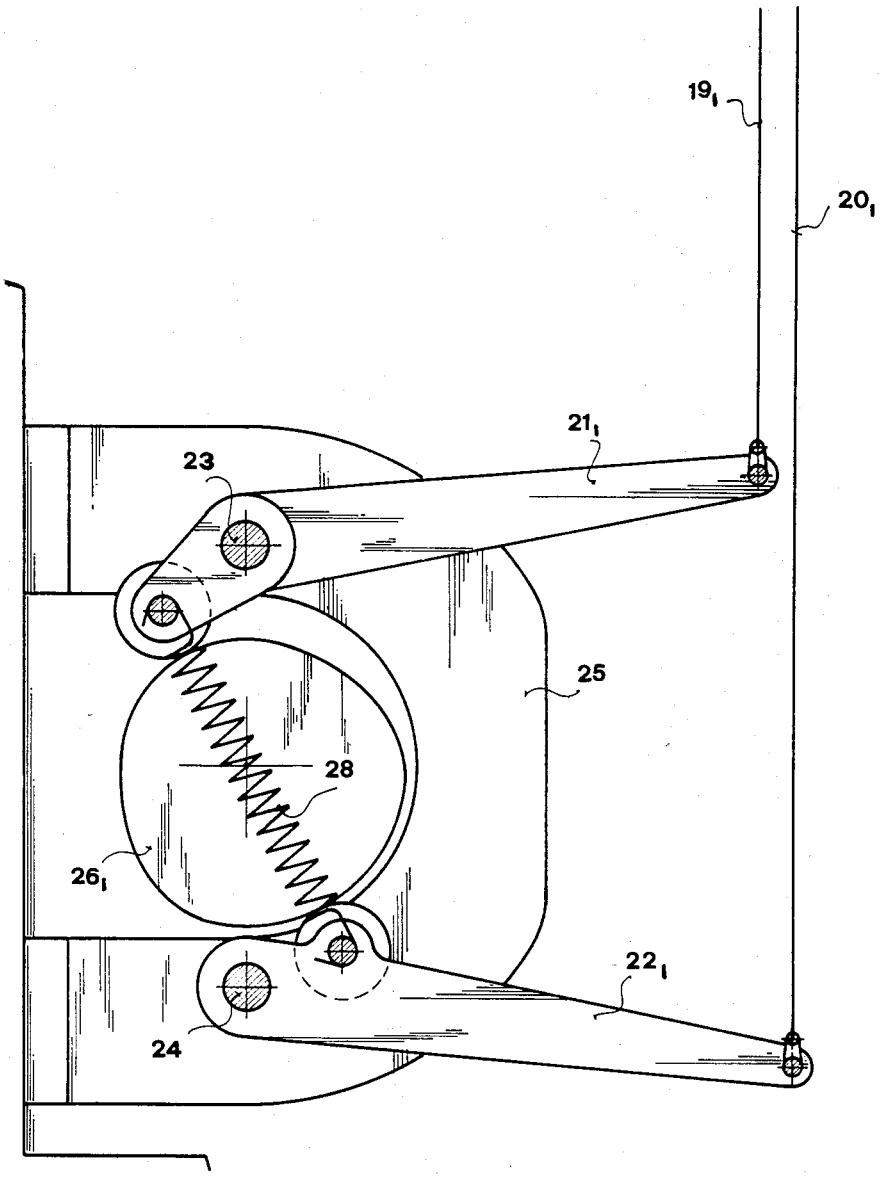
FIG. 2 is a side view of a modified embodiment of the heald control system of FIG. 1 according to the invention.
Figure 3:
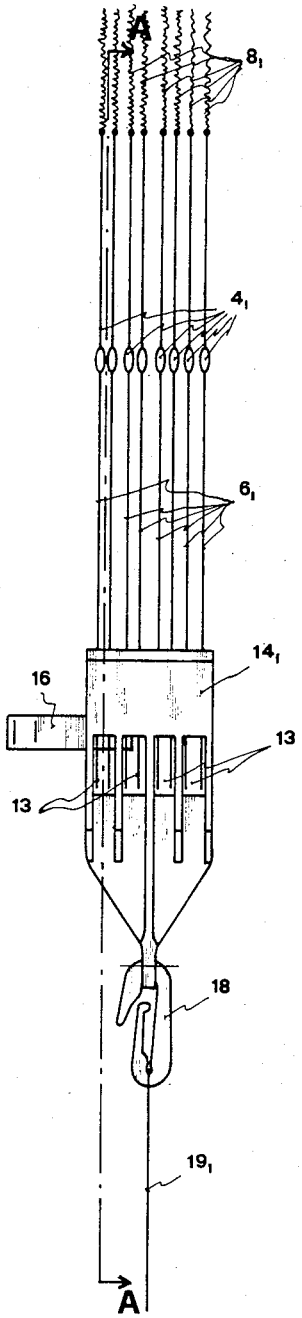
FIG. 3 is a front view of a further detail of the heald control system of FIG. 1.
Figure 4:
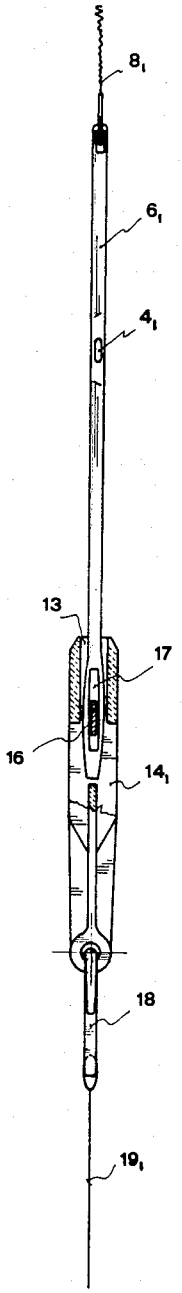
FIG. 4 is a side elevational view of the detail of FIG. 3 taken along the line AA.

In the figures, the reference numeral 1 indicates the reed of the multi-phase loom, the purpose of which is to beat the weft threads against the fell $2_1$ of the fabric under formation 2. The weft threads are inserted in succession by suitable shuttles into the sheds formed by the warp threads 3. The warp threads 3 originate from a beam not shown in the figure. The warp threads pass through the eyes $4_1$ and $5_1$ of two corresponding opposing sets of healds. The healds are divided into corresponding successive side-by-side sections $6_1$ and $7_1$, respectively. The section $6_1$ includes the healds associated with the connection block $14_1$ and the section $7_1$ includes the healds associated with connection block $15_1$. Likewise section $6_2$, $6_3$, $7_2$, and $7_3$ are associated with the connection blocks $14_2$, $14_3$, $15_2$ and $15_3$, respectively. The eyes $4_1$, $4_2$, $4^3$ are similarly associated with sections $6_1$, $6_2$ and $6_3$ and the eyes $5_1$, $5_2$, $5_3$ are similarly associated with the sections $7_1$, $7_2$, $7_3$, respectively. respectively. Each individual heald of the sections $6_1$ and $7_1$ is connected upperly, by way of its own elastic traction element $8_1$ and $9_1$, to a single support plate 10 which is removably fixed by bolts 11 to the fixed part 12 of the multi-phase loom. All the healds of the sections $6_1$ and $7_1$ insert their lower ends into vertical guide channels 13 present in corresponding connection blocks $14_1$ and $15_1$, respectively. The healds $14_1$ and $15_1$ are locked there by a transverse plate 16 which is inserted into the slots 17 present at said lower ends of the healds (see FIG. 4). The connection blocks $14_1$ and $15_1$ are themselves releasably locked, by a spring catch connector 18, to corresponding flexible elements or wires $19_1$ and $20_1$ which connect them to the end of underlying operating levers $21_1$ and $22_1$. The operating levers $21_1$ and $22_1$ are pivoted respectively on two shafts 23 and 24 supported by the fixed part 25 of the loom. The pairs of levers $21_1$, $22_1$; $21_2$, $22_2$; . . . which operate the healds of two corresponding sections $6_1$, $7_1$; $6_2$, $7_2$; . . . are controlled by the same cam $26_1$, against which they are each held by their own spring 27 (see FIG. 1). According to a modification of the invention, said pairs of levers are held against their respective control cam by a single spring 28 (see FIG. 2) acting between said levers of the individual pairs. Said operating cams $26_1$ for the corresponding pairs of levers are all fixed to one shaft 29, and are mutually offset by a predetermined angle so as to cause said blocks $14_1$ and $15_1$ to assume a wave arrangement. This arrangement gives rise to the required travelling wave shedding.

I claim:

1. A heald control system for a multi-phase loom having at least two corresponding sets of healds which are moved vertically in mutual opposition, the healds of the two sets being divided into corresponding side-by-side successive sections which are each moved, mutually offset by a predetermined angle, by a cam-controlled operating lever, said heald control system comprises; a single support plate; a plurality of elastic traction elements connected between the upper portions of said healds and said support plate; a single connection block for each set of healds, the lower portions of said healds in a set being locked to each of said connection blocks; and a plurality of flexible elements for connecting each of said connection blocks to the end of a cam-controlled operating lever.

2. A heald control system as claimed in claim 1, characterised in that said single support plate is removably locked to the fixed part of the loom and said connection blocks are connected to the respective flexible elements by a spring catch connector.

3. A heald control system as claimed in claim 1, characterised in that said connection blocks comprise vertical guide channels into which the lower ends of the healds of the section are inserted and are locked there by a transverse plate which is inserted into slots present at said heald ends.

4. A heald control system as claimed in claim 1, characterised in that the two operating levers for the healds of two corresponding sections are controlled by the same cam, against which each is held by its own spring.

5. A heald control system as claimed in claim 1, characterised in that the two operating levers for the healds of two corresponding sections are controlled by the same cam, against which they are held by a single spring acting between said two levers.

* * * * *